US008393012B2

(12) United States Patent
Shiue

(10) Patent No.: US 8,393,012 B2
(45) Date of Patent: Mar. 12, 2013

(54) WATER SPORTS GARMENTS FABRICATED USING STITCHLESS SEAMS REINFORCED BY VULCANIZATION AND CROSS-LINKING

(75) Inventor: Min-Chen Shiue, I-Lan Hsien (TW)

(73) Assignee: Shei Chung Hsin Ind. Co., Ltd., Wujei (TW)

( * ) Notice: Subject to any disclaimer, the term of this patent is extended or adjusted under 35 U.S.C. 154(b) by 300 days.

(21) Appl. No.: 12/799,707

(22) Filed: Apr. 30, 2010

(65) Prior Publication Data

US 2011/0265233 A1 Nov. 3, 2011

(51) Int. Cl.
*B63C 11/04* (2006.01)

(52) U.S. Cl. ..... 2/2.15

(58) Field of Classification Search ..... 2/2.15, 2/2.16, 69, 69.5, 81, 82
See application file for complete search history.

(56) References Cited

U.S. PATENT DOCUMENTS 4,416,027 A * 11/1983 Perla ..... 2/275
4,741,050 A * 5/1988 O'Kane et al. ..... 112/413
4,915,046 A * 4/1990 Meistrell ..... 112/419
6,415,449 B2 * 7/2002 Duplock ..... 2/275
6,514,590 B1 * 2/2003 Shih ..... 428/60
7,921,467 B2 * 4/2011 Geidenmark ..... 2/2.15

* cited by examiner

*Primary Examiner* — Tejash Patel

(57) ABSTRACT

A method of fabricating wetsuits and boots or gloves, made from rubber sponge material especially used for water sports, adheres each piece of the composition of the wetsuit or boots/gloves to be free from the problems of leaking or breaking caused by sewing or stitching. The method makes the finished garment not only strong and flexible, but also watertight so that the garment wearer feels dry and comfortable. The new method comprises the step of making an adhesion to form a cover, with the width of 1-25 mm and thickness of 0.3-1 mm, on the glued seams of the garment outer and/or inner surface in order to make each piece of the garment adhered completely with no sewing or stitching. The new method includes the additional step of putting the adhered panels of the garment into an oven at a temperature of 80-130° C., and for a time of 5-60 minutes, to make the adhesion vulcanized and cross-linked. That step forms a soft and firm cover of the seams and makes the finished products equivalent in strength to sewing or stitching but avoids the defects of leaking, breaking or discomfort caused by needle holes, thread breaking or unraveling from sewing or stitching.

12 Claims, 7 Drawing Sheets

FIG. 2A CUTTING
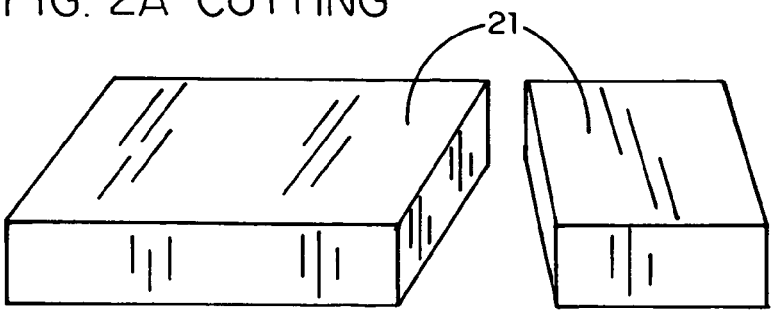
FIG. 2B GLUING
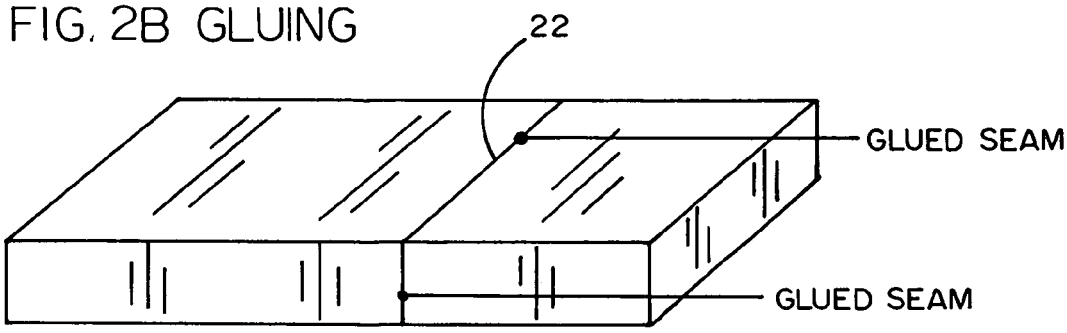
FIG. 2C SEWING
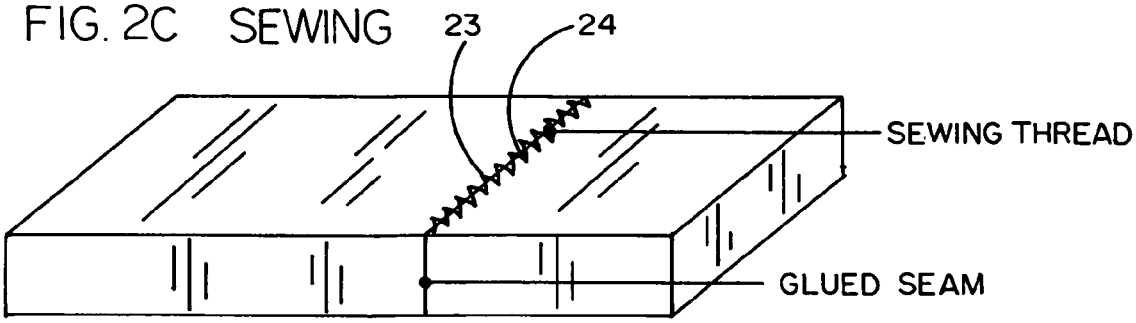

FIG. 5A CUTTING
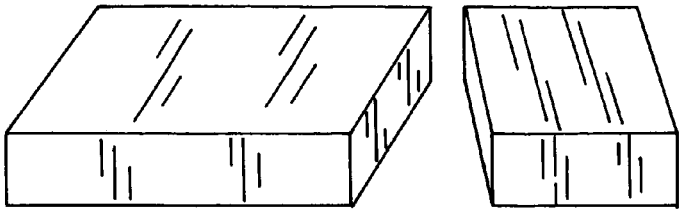
FIG. 5B GLUING
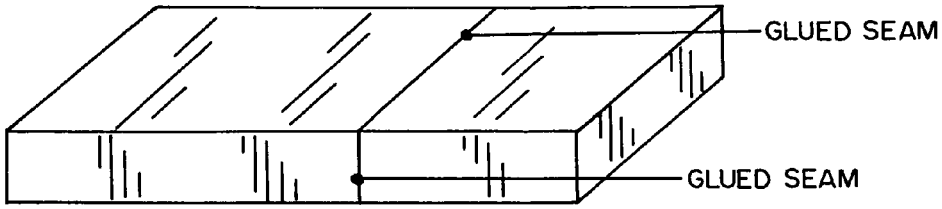
FIG. 5C SEWING
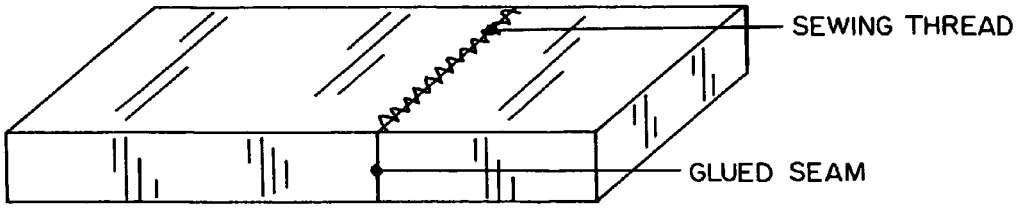
FIG. 5D TAPING
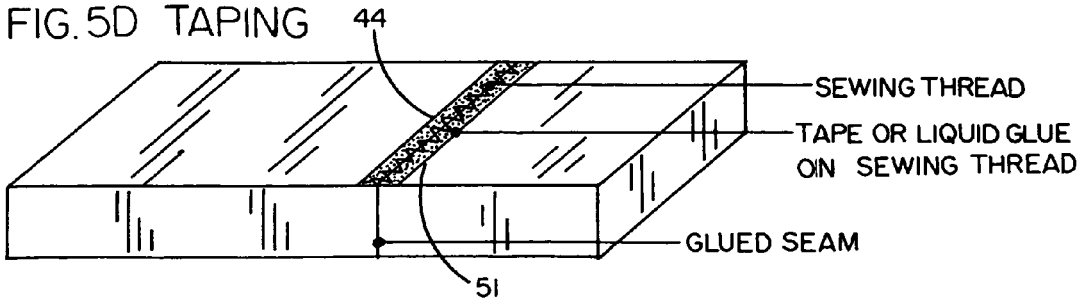

FIG. 8A CUTTING
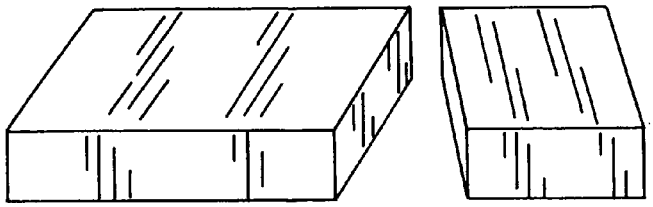
FIG. 8B GLUING
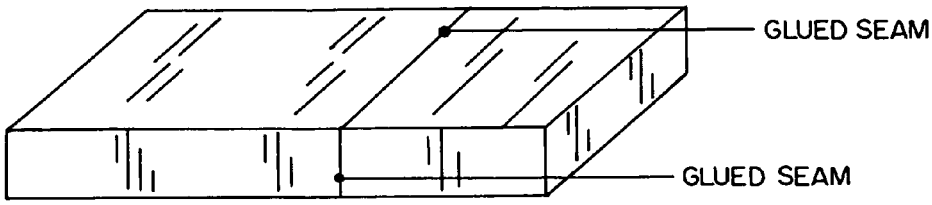
FIG. 8C COATING ADHESION
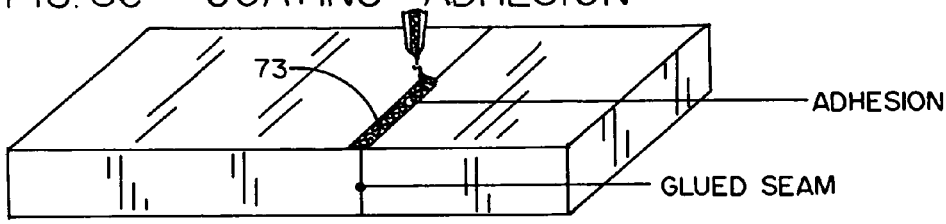
PUTTING INTO OVEN/HEATER VULCANIZED AND CROSS-LINKED
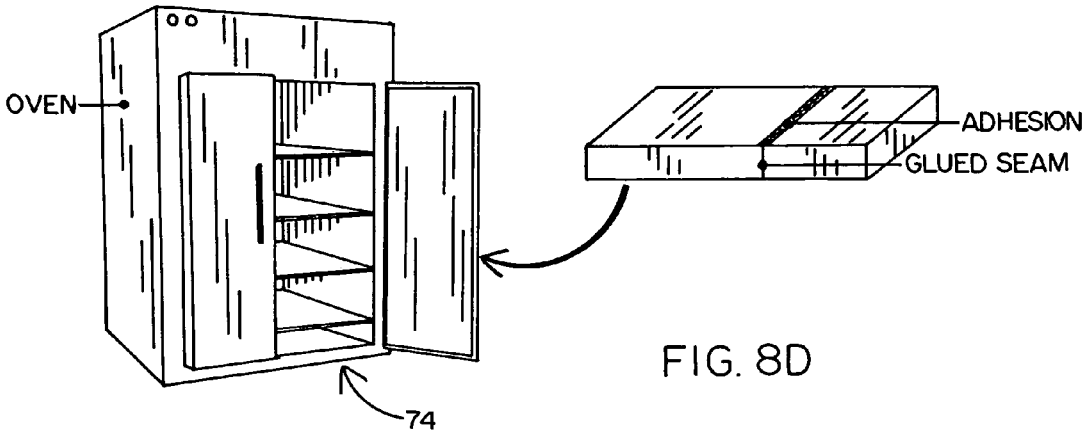
FIG. 8D

WATER SPORTS GARMENTS FABRICATED USING STITCHLESS SEAMS REINFORCED BY VULCANIZATION AND CROSS-LINKING

BACKGROUND OF THE INVENTION

1. Field of the Invention

The present invention relates to the field of wetsuits and boots/gloves used for water sports, especially those with a requirement of keeping dry while being worn in underwater sports. The new method is applied to adhere each piece of the panels of the wetsuit or boots/gloves, free from the problems of leaking or breaking caused by sewing or stitching, and the new method provides the finished wetsuit or boots/gloves with a high level of dryness that makes the wearer feel dry and comfortable.

The method includes making an adhesion to form a cover, with the width of 1-25 mm and thickness of 0.3-1 mm, on the seams of the garments outer and/or inner surface in order to make each piece of the panels of the garment adhere completely with no sewing or stitching. The new method includes the additional step of putting the adhered garment into an oven at a temperature of 80-130° C., and for a time of 5-60 minutes, (before the step of attaching any rubber reinforcements in the case of boots) to make the adhesion vulcanized and cross-linked that forms a soft and firm cover over the seams and that gives products a higher strength than sewing or stitching and avoids the defects of leaking, breaking or discomfort caused by needles holes, thread breaking or unraveling from sewing or stitching.

2. Background Art

Wetsuits and boots/gloves, used for water sports, are comprised of several sheets of rubber sponge material and employ appropriate cutting, gluing, sewing or stitching steps and then attaching any rubber reinforcements on the boots and curing.

Since the needles used in sewing or stitching cause holes which weaken the rubber sponge and generate the defect of leaking, the wet garment makes the boots/gloves or wetsuit wearer feel cold and uncomfortable. Some manufacturers use the step of sewing or stitching employing a blind stitch process to reduce the impact of needles holes. But the problem of leaking is not fully resolved, and raises the issue of breaking or unraveling, that still cause the garment to be wet and cause the wetsuit wearer to feel inflexible and uncomfortable.

Some water garment manufacturers have developed the process of using a sealant, tape or liquid glue, to cover or replace the surface of the stitched rubber sponge in order to overcome the defects caused by needle holes or sewing threads. But the sealant increases the thickness of the seam, (glue plus threads plus sealant), and that impacts the aesthetic appearance. Moreover the sealant does not have high elasticity and thus decreases the stretchability of rubber sponge.

Some wetsuit manufacturers have developed the technology of sealant to replace steps of the process of sewing or stitching. The manufacturers call it "non-stitch wetsuit" but it is actually a "partial non-stitch wetsuit", to avoid the defects caused by needle holes, or sewing threads. However, the sealant cannot be used to apply on weak points such as the crotch area of the wetsuit where the steps of sewing or stitching are still employed and even though the defect caused by needle holes or sewing threads is reduced, it is not fully solved.

The method of the present invention can satisfy the professional end-users' demands for solving these deficiencies.

SUMMARY OF THE INVENTION

The main purpose of the method of the present invention is to adhere the rubber sponge composition of the garments used for water sports especially underwater sports, without sewing or stitching and yet still provide high elasticity and strength to avoid decreasing the flexibility of the rubber sponge material and overcome the defects of leaking or breaking caused by needle holes, thread breaking or unraveling from sewing or stitching.

All of the constituent rubber sponge panels whether laminated with fabric or not, are first glued to each other to produce the garments used for water sports, and the process forms seams between edges of the panels.

The new method comprises the step of coating on one side or both sides, the adhesion on the seams as a cover, having a width of 1-25 mm and thickness of 0.3-1 mm, after the cut sheets of rubber sponges are glued together. Then, the adhered product is placed into an oven at a temperature between 80-130° C., for between 5-60 minutes, (before the step of attaching any rubber reinforcements on boots is done) to make the adhesion vulcanized and cross-linked to form a soft and firm cover of the seams. This makes the finished product higher strength than sewing or stitching and avoids the defects of leaking, breaking or discomfort caused by needle holes, thread breaking or unraveling from sewing or stitching.

The base substance of the adhesion used in the inventive method is synthetic rubber that is also the material with the highest elasticity and strength and exhibits the same flexibility as the rubber sponge of the garment itself.

BRIEF DESCRIPTION OF THE DRAWINGS

The aforementioned objects and advantages of the present new method, as well as additional objects and advantages thereof, will be more fully understood herein after as a result of a detailed description of a preferred embodiment when taken in conjunction with the following drawings in which:

FIG. 2A is a cross sectional view showing the structure of the rubber sponges, under the process of "Cutting" in the conventional method of blind stitching;

FIG. 2B is a cross sectional view showing the structure of the rubber sponges after the process of "Gluing" in the conventional method of blind stitching;

FIG. 2C is a cross sectional view showing the structure of the rubber sponges, after the process of "Sewing" in the conventional method of blind stitching;

FIG. 5A is a cross sectional view showing the structure of the rubber sponges, after the step of "Cutting" of the conventional method of using sealant to cover the sewing threads;

FIG. 5B is a cross sectional view showing the structure of the rubber sponges after the step of "Gluing" of the conventional method of using sealant to cover the sewing threads;

FIG. 5C is a cross sectional view showing the structure of the rubber sponges after the step of "Sewing" of the conventional method of using sealant to cover the sewing threads;

FIG. 5D is a cross sectional view showing the structure of the rubber sponges after the step of "Taping", (tape or liquid glue) of the conventional method of using sealant to cover the sewing threads;

FIG. 8A is a cross sectional view showing the structure of the rubber sponges in the process of "Cutting" of the new method;

FIG. 8B is a cross sectional view showing the structure of the rubber sponges in the process of "Gluing" of the new method;

FIG. 8C is a cross sectional view showing the structure of the rubber sponges in the process of "Coating Adhesion" of the new method;

FIG. 8D is a cross sectional view showing the structure of the rubber sponges in the process of "Vulcanizing", putting the adhesion coated product into the oven or other heating equipments to make the coated adhesion vulcanized and cross linked;

DETAILED DESCRIPTION OF A PREFERRED EMBODIMENT

Figure 1:
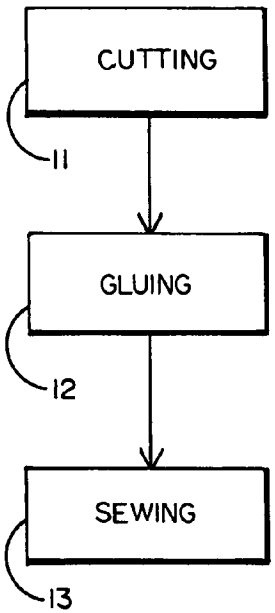
FIG. 1 is a flow chart showing the process of sticking the rubber sponge of a water sports garment used for water sports, in the conventional method of blind stitching.

With reference to FIG. 1, what is shown is the step of attaching the panels of the water sports garment, made from rubber sponges, used for water sports under the conventional method of sewing or stitching including cutting (11), gluing (12), sewing (13), attaching rubber reinforcements for boots (14), and curing (15).

Figure 3:
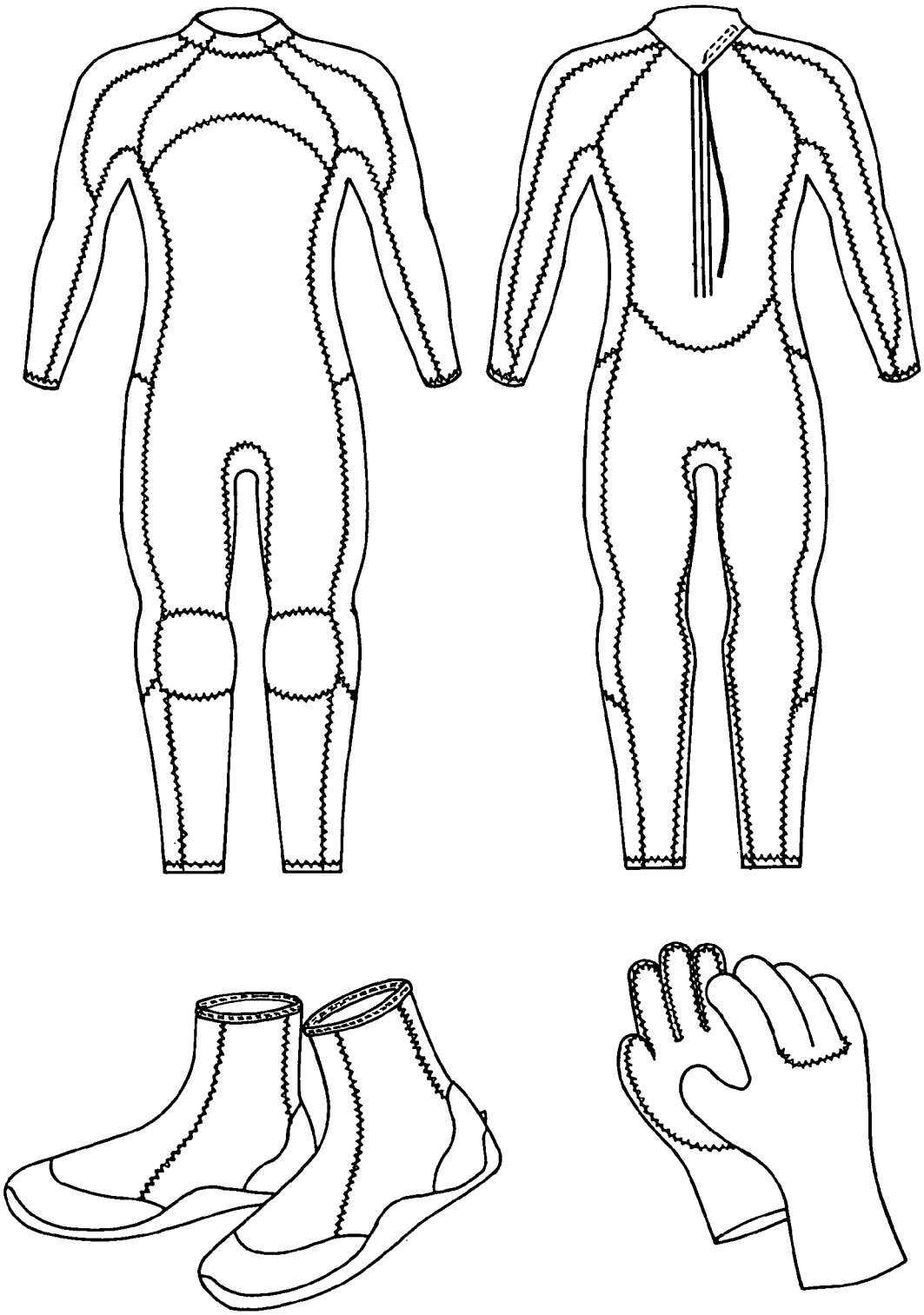
FIG. 3 is a front view of a water sports garment manufactured in the conventional method of blind stitching.

The rubber sponges (21), whether laminated with fabric or not, are glued to be attached to each other, which form seams (22) between each border of rubber sponges, to comprise a boot/glove (31)(32). Since the needle holes (23) of sewing or stitching will weaken the strength of rubber sponge or generate the defect of leaking, some wetsuit manufacturers developed the step of sewing or stitching using blind stitching to reduce the impact of needle holes. But the problem of leaking is not fully settled. Sewing threads (24) always raise the problem of breaking or unraveling, and the sewing threads (24) limit the stretchability of rubber sponge that makes a wetsuit wearer feel inflexible and uncomfortable as shown in FIG. 2. & FIG. 3.

Figure 4:
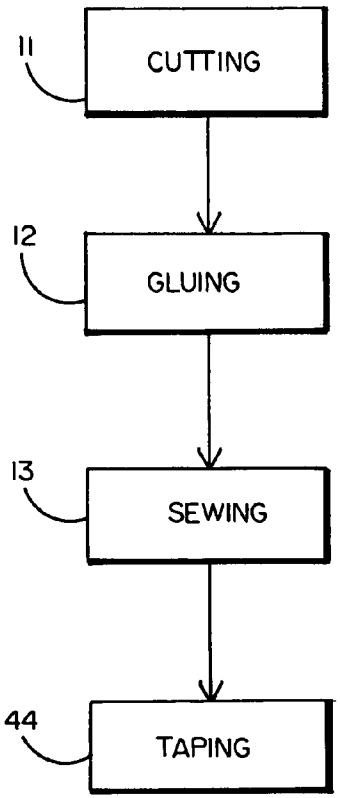
FIG. 4 is a flow chart showing the process of sticking the rubber sponge of a water sports garment in the conventional method of coating sealant, tape or liquid glue, after sewing or stitching.
Figure 6:
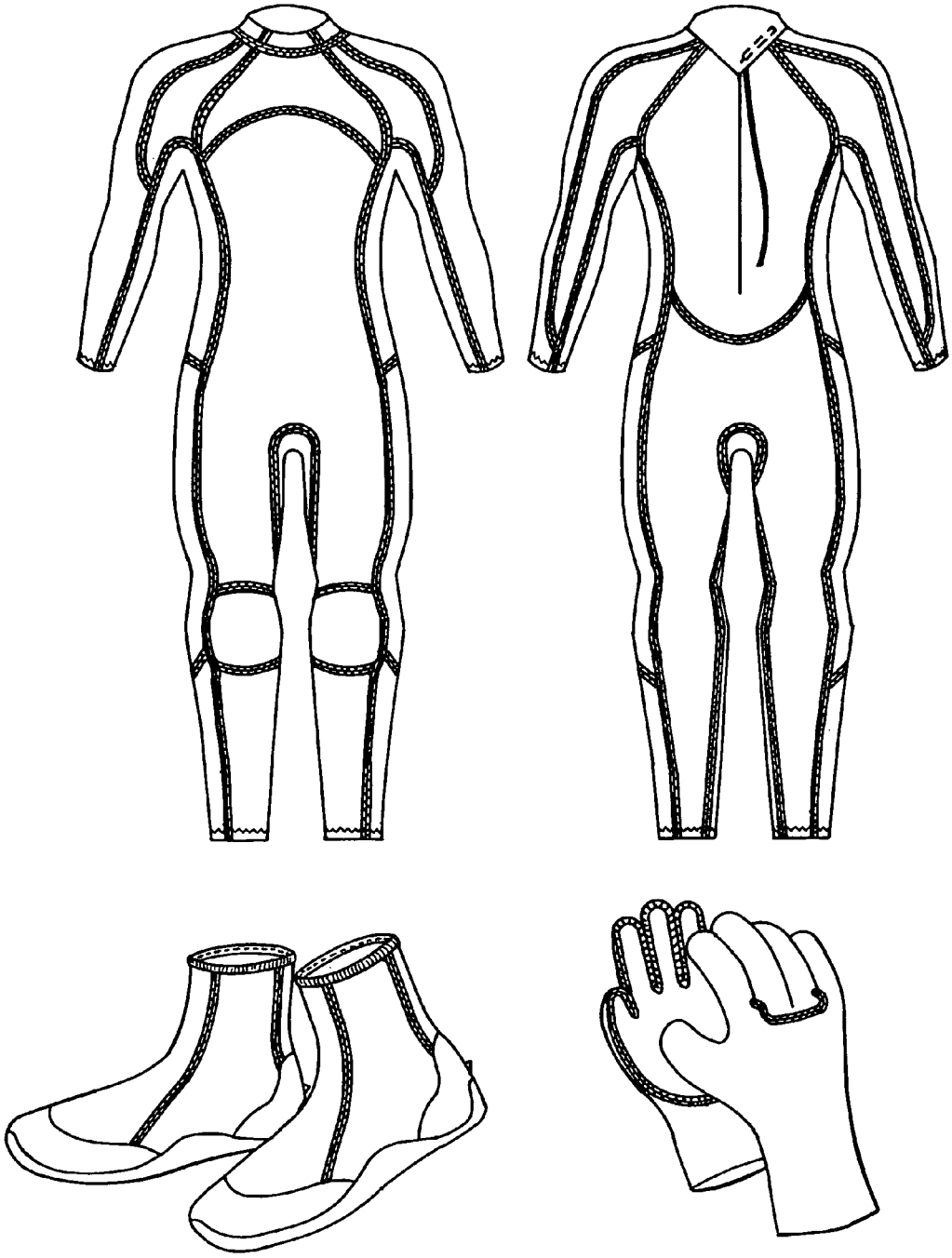
FIG. 6 is a front view of a water sports garment manufactured in the conventional method of using sealant to cover the sewing threads after sewing or stitching.

Some water sports garment manufacturers develop the process of sewing or stitching to add a step of taping (44), to use sealant (51), tape or liquid glue, to cover the surface of the stitched rubber sponge in order to overcome the defects caused by needle holes or sewing threads. But the sealant will increase the thickness of the seam, (glue plus threads plus sealant), that will impact the aesthetics of the garment, and the sealant is inelastic and decreases the stretchability of rubber sponge. The sewing threads still impact the elasticity of rubber sponge and the sealant cannot provide high elasticity and limits the stretchability of rubber sponge that make the wearer unsatisfied as shown in FIG. 4-FIG. 6.

The new method comprises the step by applying adhesive coating (73) on the seams of two cut sheets of rubber sponges as glued together, having a width of 1~25 mm and a thickness of 0.3~1 mm, after the two cut sheets of rubber sponges have been glued together and before the process of attaching any rubber reinforcements on the boots. Then, the adhered product is placed into an oven at a temperature between 80~130° C., and for a time between 5~60 minutes, to vulcanize and cross-link the adhesive coating on the seams with the cut sheets of rubber sponge to form a soft and firm coating on the seams that makes the finished product higher strength than sewing or stitching and avoids the defects of leaking, breaking or discomfort caused by needle holes, thread breaking or unraveling from sewing or stitching.

Figure 7:
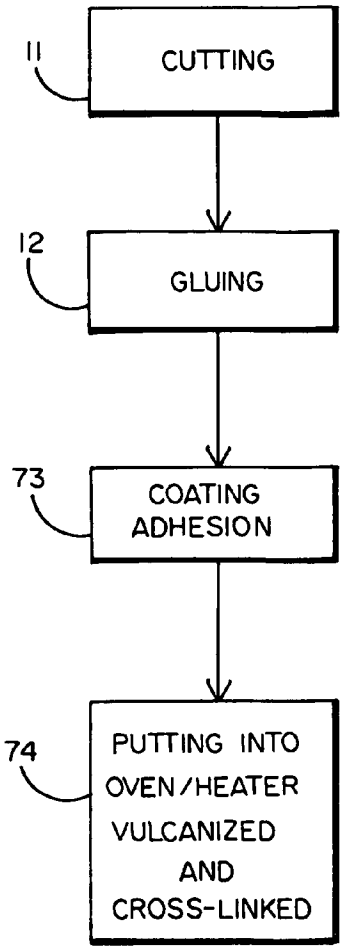
FIG. 7 is a flow chart showing the process of sticking the rubber sponge of the boots/gloves, made from rubber sponges, used for water sports under the new method.
Figure 9B:
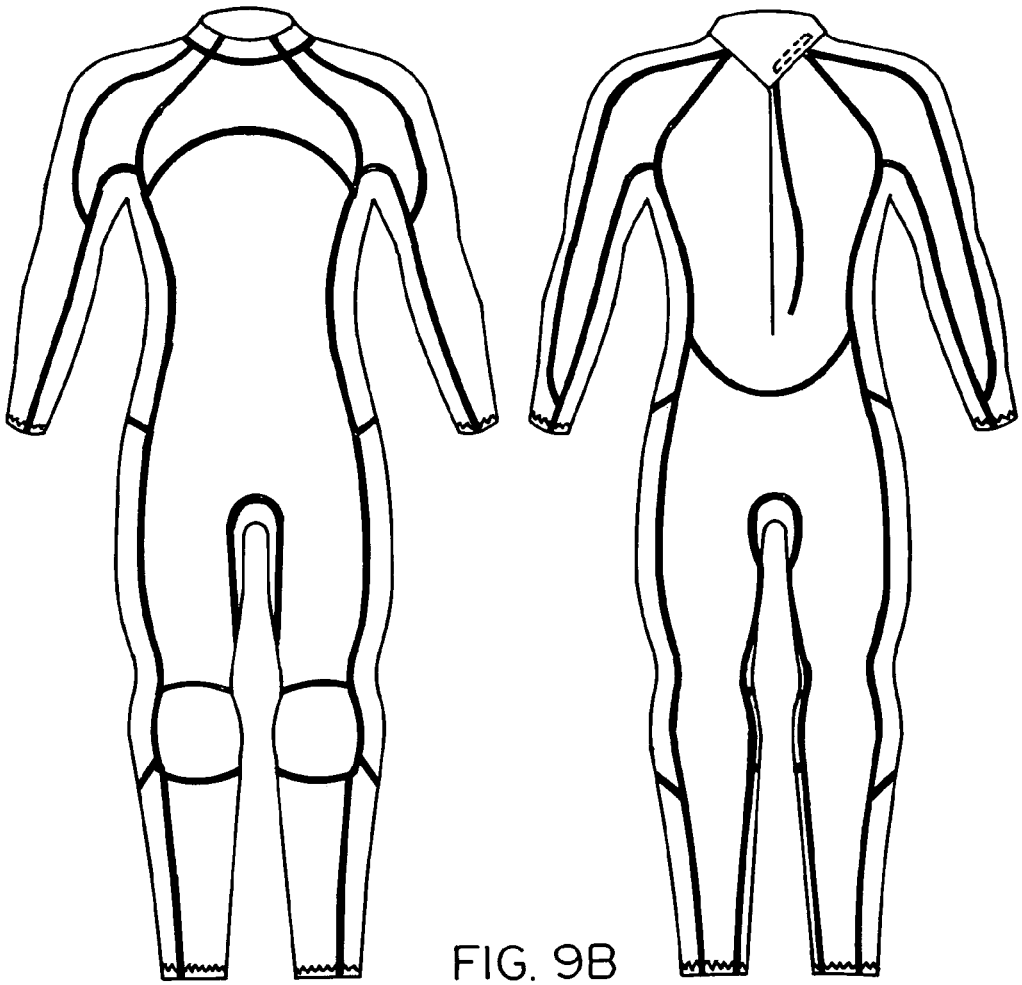
FIG. 9B is a front view of a wetsuit manufactured under the new method.
Figure 9A:
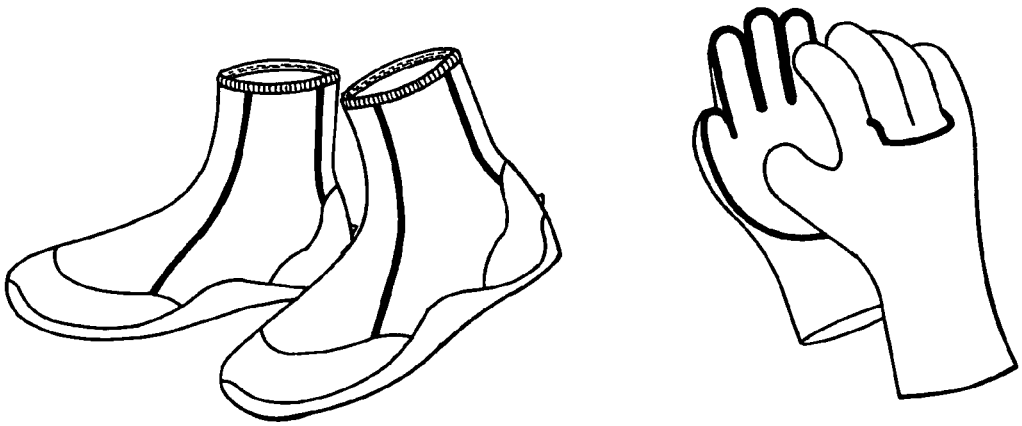
FIG. 9A is a front view of a boot/glove manufactured under the new method.

The base substance of the adhesive used in the new method is synthetic rubber that is the material with highest elasticity and strength and can perform with the same flexibility as rubber sponge as shown in FIG. 7~FIG. 9.

It will thus be understood that the process of the present invention is intended to permit fabrication of a wetsuit or of gloves or boots as wetsuit accessories or other garments for water sports such as diving or the like, where use of sewing or stitching with needles and thread is entirely obviated. By instead gluing garment panels to one another and then applying an adhesion bead of synthetic rubber over the glued seam and vulcanizing that bead at a selected temperature for a selected period of time, the finished garment is still strong, flexible, comfortable and remains dry under water. Although the invention has been described herein by illustration of an exemplary embodiment, the scope hereof will be defined by the appended claims.

The invention claimed is:

1. A water sports garment comprising at least two interconnected panels of rubber sponge that are glued with each other along an interfacing seam thereof to obviate stitching, said seam coated with a rubber adhesive coating and said two panels of rubber sponge as glued together and coated with said rubber adhesive coating that are vulcanized by heating to cross-link said adhesive coating with said two panels of said rubber sponge to obtain a garment to provide strength and flexibility and avoid water leakage.

2. The garment of claim 1 wherein said adhesive coating has a width of 1 to 25 mm and a thickness of 0.3 to 1.0 mm.

3. The garment of claim 1 wherein said heating is performed at a temperature of 80° C. to 130° C.

4. The garment of claim 3 wherein said heating is performed for a period of 5 to 60 minutes.

5. The garment of claim 1 wherein said garment includes a wetsuit.

6. The garment of claim 1 wherein said garment includes a boot.

7. The garment of claim 1 wherein said garment includes a glove.

8. The garment of claim 1 wherein said rubber adhesive coating is made of synthetic rubber.

9. A method of fabricating a water sports garment having at least two interconnected panels of rubber sponge that are glued with each other along an interfacing seam thereof to obviate stitching; the method comprising the steps of:

a. applying a rubber adhesive coating on said seam between said two panels; and b. heating said two panels as glued together and coated with said adhesive coating for vulcanization thereof for crosslinking said adhesive coating with said two panels as glued together.

10. The method of claim 9 wherein said adhesive coating is applied for a width of 1 to 25 mm and a thickness of 0.3 to 1.0 mm.

11. The method of claim 9 wherein said heating is performed in a temperature range of 80° C. to 130° C.

12. The method of claim 9 wherein said heating is performed for 5 to 60 minutes.

* * * * *